US008707870B2

(12) United States Patent
Timan et al.

(10) Patent No.: US 8,707,870 B2
(45) **Date of Patent: *Apr. 29, 2014**

(54) MONORAIL BOGIE HAVING A TRACTION/PITCHING CONTROL ASSEMBLY

(71) Applicant: Bombardier Transportation GmbH, Berlin (DE)

(72) Inventors: Peter Edward Timan, Sydenham (CA); Friedrich Wilhelm Honegger, Hemmental (CH)

(73) Assignee: Bombardier Transportation GmbH, Berlin (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/646,343

(22) Filed: Oct. 5, 2012

(65) Prior Publication Data

US 2013/0092046 A1 Apr. 18, 2013

Related U.S. Application Data

(63) Continuation of application No. 13/148,246, filed as application No. PCT/CA2009/001487 on Oct. 16, 2009, now Pat. No. 8,316,775.

(51) Int. Cl.
*B61B 13/04* (2006.01)

(52) U.S. Cl.
USPC ..... 105/144

(58) Field of Classification Search
USPC ..... 105/141, 144, 145
See application file for complete search history.

(56) References Cited

U.S. PATENT DOCUMENTS

| | | | |
|---|---|---|---|
| 3,017,838 | A | 1/1962 | Bingham |
| 3,092,040 | A | 6/1963 | Bingham |
| 3,143,977 | A | 8/1964 | Deller |
| 3,216,371 | A | 11/1965 | Holmquist et al. |

(Continued)

FOREIGN PATENT DOCUMENTS

| | | |
|---|---|---|
| CA | 654092 | 12/1962 |
| CA | 1327916 | 3/1994 |

(Continued)

OTHER PUBLICATIONS

International Search Report in connection with International Patent Application No. PCT/CA2009/001487, mailed Jul. 15, 2010.

(Continued)

*Primary Examiner* — Zachary Kuhfuss
(74) *Attorney, Agent, or Firm* — Alston & Bird LLP

(57) ABSTRACT

A traction/pitching control assembly for attachment to a body portion of a monorail bogie. The monorail bogie is operative for supporting a monorail car over a monorail track that has a running surface and two side surfaces. The assembly comprises a first traction link, a second traction link and a linking member that has a first end portion and a second end portion. The first traction link is attached to the first end portion of the linking member, and the second traction link is attached to the second end portion of the linking member. The assembly further comprises a third traction link and a cross link. The cross link joins the third traction link to the first traction link and the linking member. The first traction link and the second traction link are attached to one of the body portion of the monorail bogie and the monorail car, and the linking member is connected to the other one of the body portion of the monorail bogie and the monorail car.

34 Claims, 15 Drawing Sheets

(56) References Cited

U.S. PATENT DOCUMENTS

| | | | |
|---|---|---|---|
| 3,584,583 | A | 6/1971 | Cartwright |
| 3,602,152 | A | 8/1971 | Hawes |
| 4,133,268 | A | 1/1979 | Guillaumin |
| 4,362,108 | A | 12/1982 | Jenkner |
| 4,485,743 | A | 12/1984 | Roush et al. |
| 4,825,774 | A | 5/1989 | Tani et al. |
| 4,843,971 | A | 7/1989 | Braunagel |
| 4,926,756 | A | 5/1990 | Smith et al. |
| 4,953,472 | A | 9/1990 | Tutzer |
| 4,996,928 | A | 3/1991 | Janssen et al. |
| 6,523,481 | B2 | 2/2003 | Hara et al. |
| 7,823,512 | B2 | 11/2010 | Timan et al. |
| 7,963,229 | B2 | 6/2011 | Timan |
| 8,316,775 | B2 | 11/2012 | Timan et al. |
| 2004/0144283 | A1 | 7/2004 | Brunet |
| 2005/0241525 | A1 | 11/2005 | Coakley |

FOREIGN PATENT DOCUMENTS

| | | | |
|---|---|---|---|
| CA | 2337977 | | 9/2001 |
| JP | 50-083912 | A | 7/1975 |
| JP | 59-020766 | A | 2/1984 |
| JP | 64-028066 | | 1/1989 |
| JP | 64-078967 | | 3/1989 |
| JP | 02-070804 | | 3/1990 |
| JP | 03-262173 | | 11/1991 |
| JP | 2000-071980 | | 3/2000 |
| JP | 2000-264198 | | 9/2000 |
| NL | 277341 | | 11/1964 |

OTHER PUBLICATIONS

Office Action for European Application No. 09737559.6; dated Apr. 25, 2012.
Office Action for U.S. Appl. No. 13/148,246; dated Nov. 9, 2011.
Office Action for U.S. Appl. No. 13/148,246; dated Apr. 11, 2012.
Office Action issued by the Canadian Intellectual Property Office in connection with Canadian Patent Application No. 2,708,885; dated Nov. 23, 2010.
Notice of Allowance issued by the Canadian Intellectual Property Office in connection with Canadian Patent Application No. 2,708,885; dated Mar. 9, 2011.
International Search Report in connection with International Patent Application No. PCT/CA2009/001487, mailed. Jul. 15, 2010.
Written Opinion in connection with International Patent Application No. PCT/CA2009/001487, mailed Jul. 15, 2010.
Office Action issued by the USPTO in connection with U.S. Appl. No. 12/149,149; mailed Oct. 29, 2009.
Office Action issued by the USPTO in connection with U.S. Appl. No. 12/149,149; mailed Apr. 26, 2010.
Office Action issued by the USPTO in connection with U.S. Appl. No. 12/129,222; mailed Aug. 6, 2010.
Office Action issued by the USPTO in connection with U.S. Appl. No. 12/129,222; mailed Nov. 22, 2010.
International Search Report in connection with International Patent Application No. PCT/CA2009/000161; mailed May 25, 2009.
Written Opinion in connection with International Patent Application No. PCT/CA2009/000161; mailed May 25, 2009.
International Search Report in connection with International Patent Application No. PCT/CA2009/000162; mailed May 25, 2009.
Written Opinion in connection with International Patent Application No. PCT/CA2009/000162; mailed May 25, 2009.

MONORAIL BOGIE HAVING A TRACTION/PITCHING CONTROL ASSEMBLY

CROSS REFERENCE TO RELATED APPLICATIONS

This application is a continuation of U.S. application Ser. No. 13/148,246, filed Aug. 5, 2011, which claims priority from PCT/CA2009/001487, filed Oct. 16, 2009, each of which is incorporated herein in its entirety.

FIELD OF THE INVENTION

The present invention relates to the field of monorail bogies for supporting monorail cars, and more specifically, to single axle monorail bogies that include traction/pitching control assemblies.

BACKGROUND OF THE INVENTION

Monorail bogies for supporting monorail cars are known in the art, and are used in many monorail car assemblies. The monorail bogies are generally used for supporting the running wheels and guide wheels beneath the monorail cars.

Historically, in order to control pitching movement, single axle monorail bogies utilize stiff dual parallel traction rods that are located on the bogie transverse center line, vertically displaced above each other and above the monorail guide-beam running surface. This arrangement provides both traction restraint and pitching stability of the single axle bogie. However, the traction rods are mounted above the running surface of the monorail guide beam and thus require additional wheel well undercar space (particularly for low floor height applications) to accommodate the traction rods. This increased wheel well results in reduced passenger compartment space thus having the detrimental effect of reducing the potential passenger carrying capacity of the monorail vehicle. In addition, the location of the traction links above the running surface of the monorail guide beam inherently results in an induced pitching moment when traction forces are applied to the bogie. This pitching moment when reacted by the offset traction rods will inherently result in a detrimental pitching angle of the bogie relative to the monorail guide beam, resulting in guide tire scrubbing and increased guide tire wear. In order to minimize this detrimental pitching angle of the bogie, the traction linkage is typically set to a high stiffness which in turn has the detrimental effect of reduced vibration isolation between the bogie and the monorail car body resulting in reduced ride quality.

In light of the above, it can be seen that there is a need in the industry for an improved monorail bogie that includes a traction restraint and pitch control mechanism that permits independent selection of pitch control stiffness and longitudinal stiffness relative to the car body, and that alleviates, at least in part, the deficiencies of the prior art, and improves on the overall functionality of existing monorail bogies.

SUMMARY OF THE INVENTION

In accordance with a first broad aspect, the present invention provides a traction/pitching control assembly adapted to be connected to a monorail bogie frame. The traction/pitching control assembly comprises at least a first and a second traction link and a first linking member. Each traction link has a first end and a second end and the first linking member has a first end and a second end. The first ends of the first and second traction links are connected to the respective first and second ends of the first linking member and the second ends of the first and second traction links are connected to the bogie frame.

In accordance with a second broad aspect, the present invention provides a monorail bogie assembly for supporting a monorail car. The monorail bogie assembly comprises a monorail bogie body portion that includes at least one load bearing wheel and at least one guide wheel and one stabilizing wheel on either side, and a traction/pitching control assembly connected to the monorail bogie assembly. The traction/pitching control assembly comprises at least a first and a second traction link, each having a first end and a second end and a first linking member having a first end and a second end. The first ends of the first and second traction links are connected to the first and second ends of the first linking member and the second ends of the first and second traction links are connected to at least one of the monorail bogie body portion and the monorail car.

In accordance with a third broad aspect, the present invention provides a method for manufacturing a single-axle monorail bogie having traction/pitching control. The method comprises providing a body portion of a single-axle monorail bogie capable of supporting a monorail car over a monorail track, the monorail track has a running surface, a first side surface and a second side surface. The method further comprises providing at least a set of guide wheels on the body portion. Each guide wheel is adapted to contact at least one of the first and the second side surfaces of the monorail track. The method further comprises providing at least a set of stabilizing wheels on the body portion. Each stabilizing wheel is adapted to contact at least one of the first and the second side surface of the monorail track. The method further comprises mounting a traction/pitching control assembly to the body portion of the monorail bogie.

These and other aspects and features of the present invention will now become apparent to those of ordinary skill in the art upon review of the following description of specific embodiments of the invention and the accompanying drawings. It will also be apparent that this invention could be applied to other technologies having single axle bogies including but not limited to rail vehicles, trolleys, wheeled carts without guide wheels, automotive applications, etc.

Other aspects and features of the present invention will become apparent to those ordinarily skilled in the art upon review of the following description of specific embodiments of the invention in conjunction with the accompanying figures.

DETAILED DESCRIPTION

Figure 1:
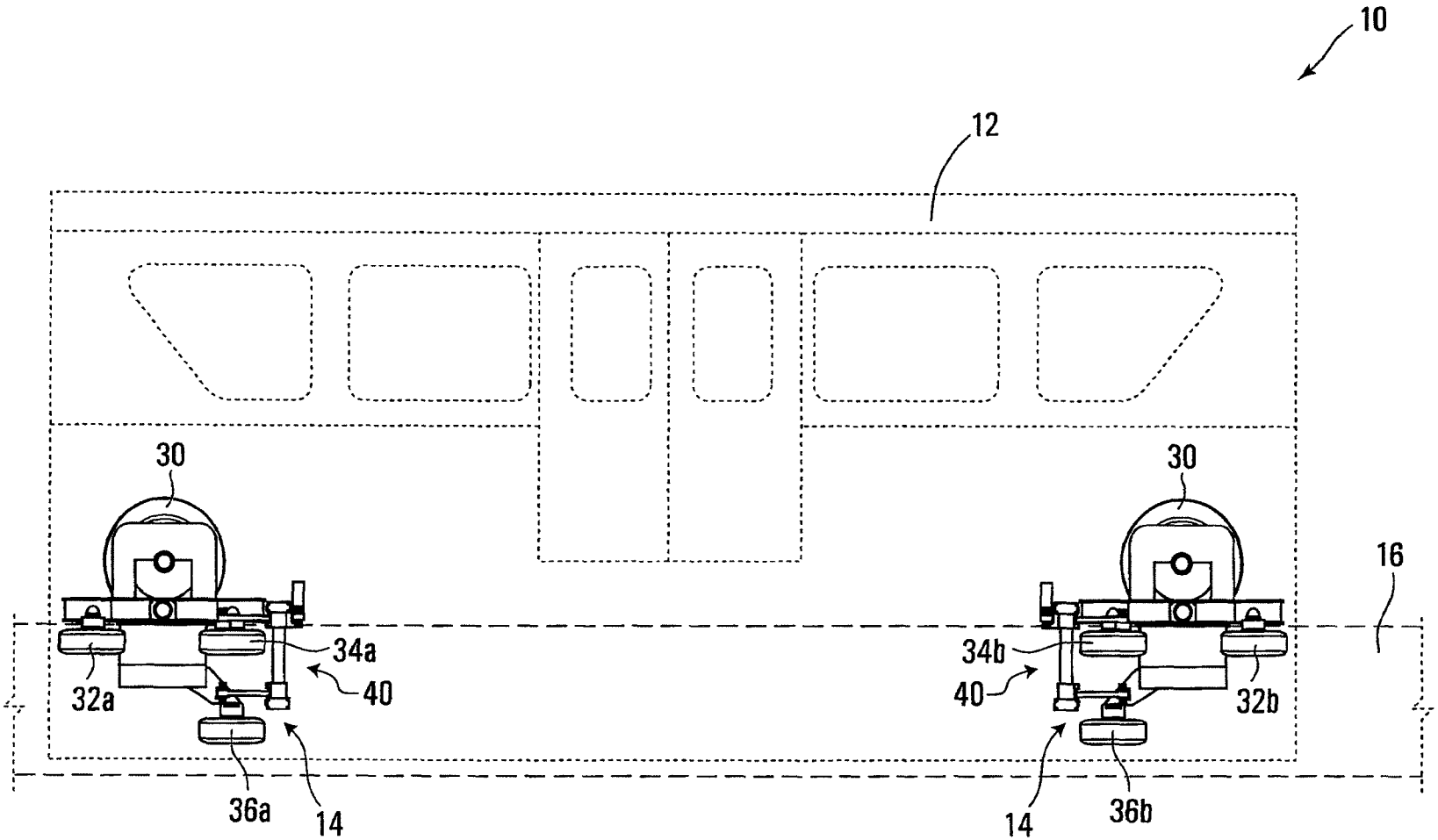
FIG. 1 shows a side view of two single-axle bogies in accordance with a first non-limiting example of implementation of the present invention for supporting a monorail car which is shown in dotted lines.

Referring to the drawings and particularly to FIG. 1, a non-limiting example of a monorail car assembly 10 that is suitable for travelling over a monorail track 16 is illustrated. The monorail car assembly 10 comprises a monorail car 12 and two single-axle bogies 14 that are operative for supporting the monorail car 12 over the monorail track 16. As will be described herein below, the single-axle bogies 14 in accordance with the present invention each include a combined traction/pitching control assembly 40 that help to manage longitudinal traction forces and reduce the pitching movement of each of the single-axle bogie 14 in relation to the monorail car 12.

Although the monorail car 12 shown in FIG. 1 is a passenger car, it should be appreciated that in an alternative embodiment, the monorail car 12 could also be a cargo car, without departing from the spirit of the invention. As such, the single-axle bogies 14 described herein can be used for any type of rail car, such as passenger cars or cargo cars, among other possibilities.

Figure 2:
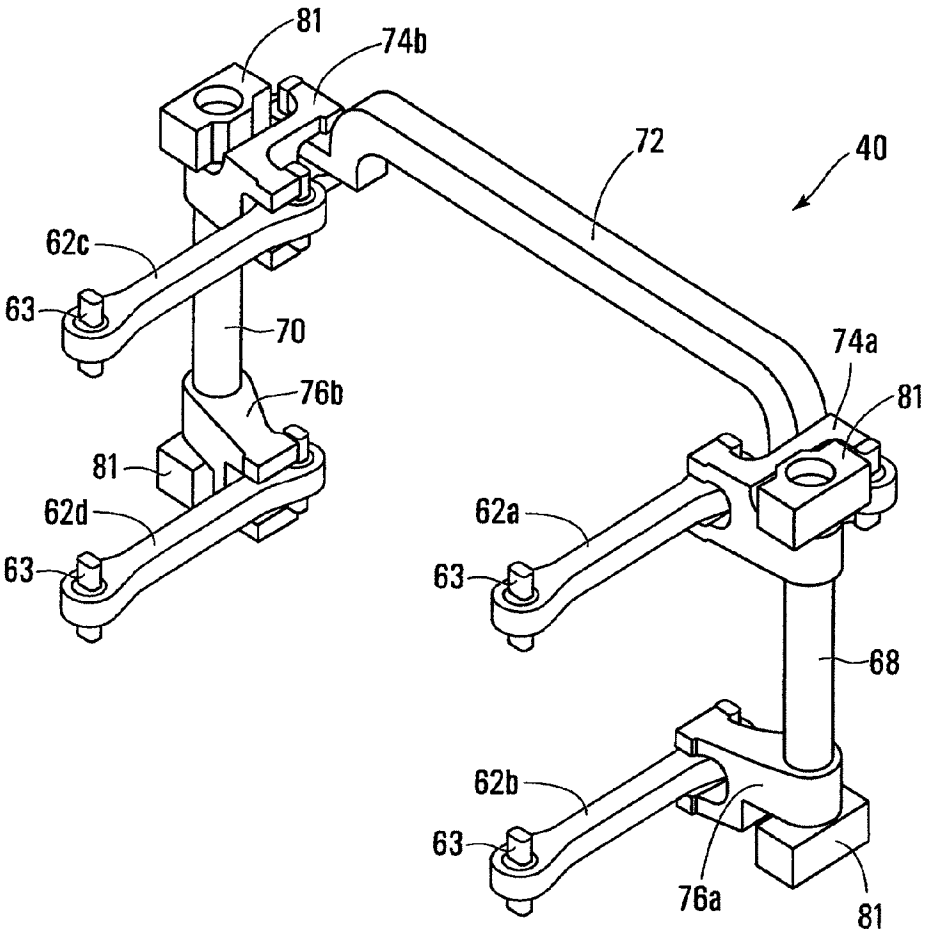
FIG. 2 shows a front perspective view of a traction/pitching control assembly according to a first non-limiting example of implementation of the present invention.
Figure 3:
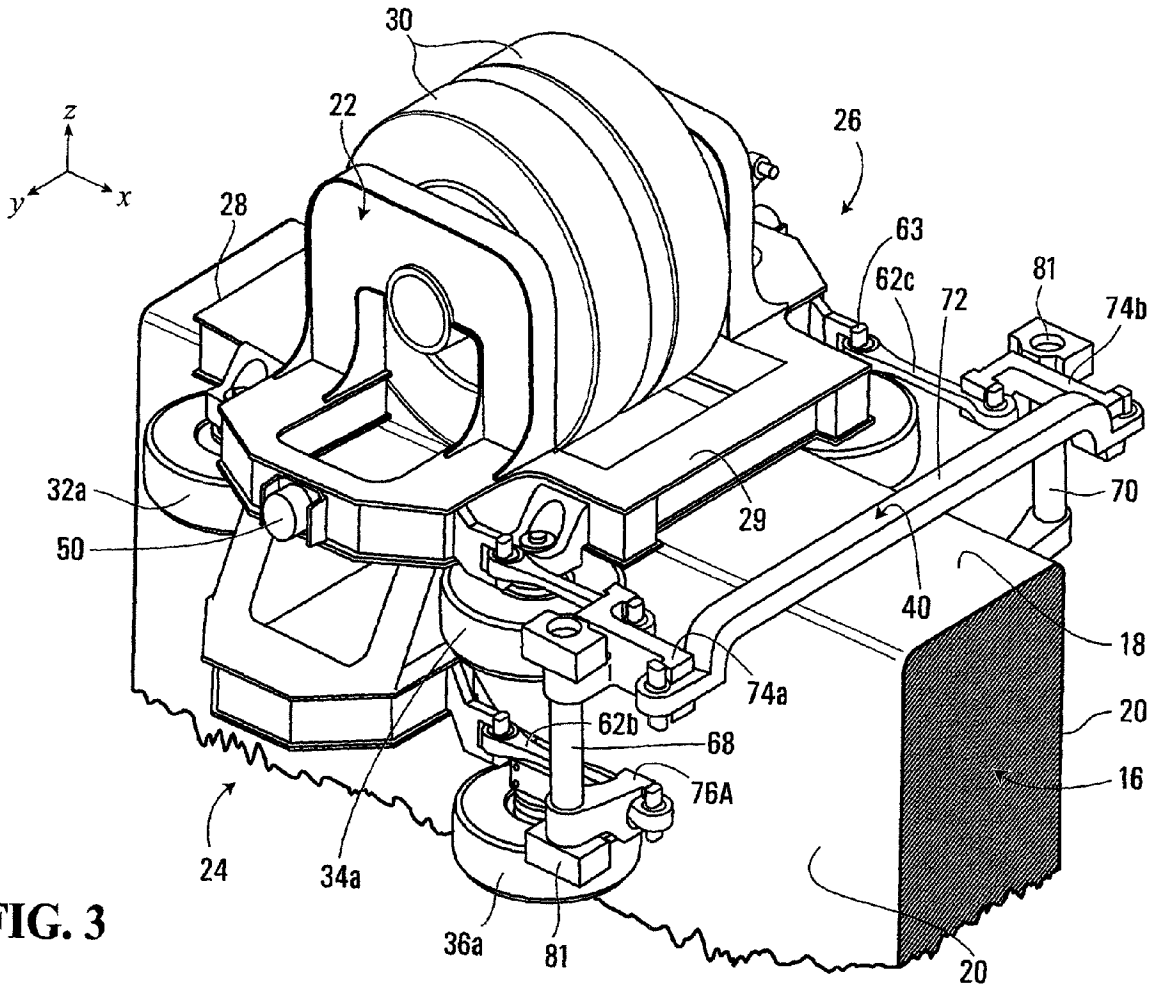
FIG. 3 shows a rear perspective view of the traction/pitching control assembly of FIG. 2 attached to a single axle bogie.

Illustrated in FIG. 2 is a perspective view of the traction/pitching control assembly 40 in accordance with a non-limiting example of implementation of the present invention. For ease of understanding, the traction/pitching control assembly 40 is shown unattached to a bogie, such that each of the components of the traction/pitching control assembly 40 (which will be described in more detail below) can be seen clearly.

As described below, the traction/pitching control assembly 40 of the present invention enables the simultaneous restraint of traction movement and pitching movement, while permitting free yaw rotation as well as free vertical, lateral and roil movement of the single-axle bogie 14 in relation to the monorail car 12. In so doing, the traction/pitching control assembly 40 provides noise and vibration isolation of the passenger compartment while maintaining firm guide tire alignment and adjustment. In addition, the present traction/pitching control assembly 40 permits the stiffness and damping characteristics for each of the traction restraints and pitching restraints to be selected and defined independently.

As shown in FIG. 2, the traction/pitching control assembly 40 comprises traction links 62*a* and 62*b* on a first side of the traction/pitching control assembly 40, and traction links 62*c* and 62*d* on a second side of the traction/pitching control assembly 40. The traction links 62*a*, 62*c* (which are the upper traction links in the assembly 40) are connected to attachment members 74*a* and 74*b* respectively. Connecting the two attachment members 74*a* and 74*b* is a cross link 72. The traction links 62*a*, 62*c* in combination with attachment members 74*a* and 74*b* and cross-link 72 can be considered a traction link assembly for absorbing traction forces and restraining traction movement applied to the monorail bogie 14.

Interconnecting the traction links 62*a*, 62*b* is a first linking member 68 and interconnecting the traction links 62*c* 62*d* is a second linking member 70. The first linking member 68 and the second linking member 70 can each be considered a torsion bar that in combination with the traction links 62*a*, 62*c* (namely the upper traction links) and the traction links 62*b*, 62*d* (namely the lower traction links), control the pitching movement of the monorail bogie 14. It should be noted that either linking member 68 or linking member 70 in combination with either the traction links 62*b* or the traction links 62*c*, 62*d* is sufficient to provide pitching control for the bogie 14. It will be appreciated by those skilled in the art that for the arrangement having redundant linking members 68 and 70, it will be possible to retain traction and pitch control even in the event of a single failure of any one of the traction links 62*a*, 62*c*, or 62*d*.

Figure 5:
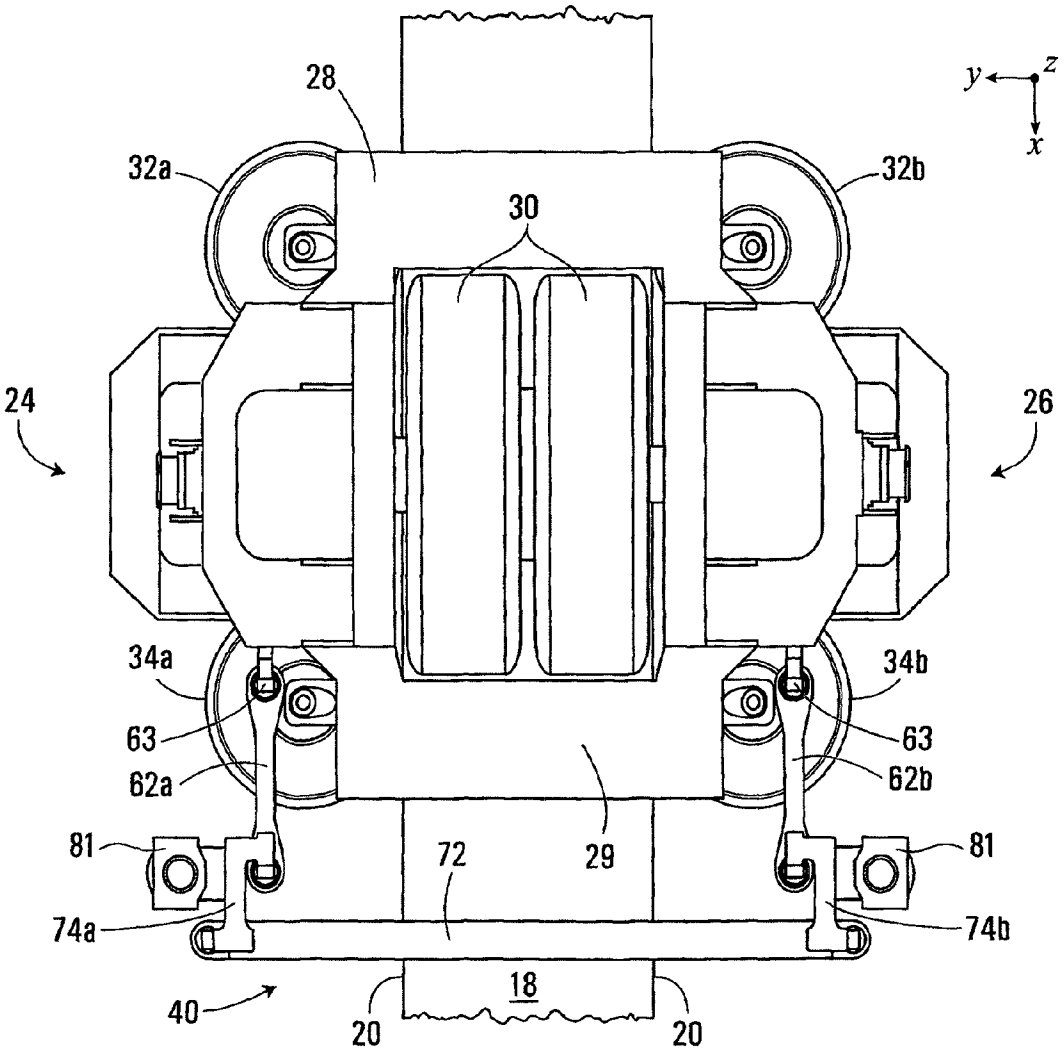
FIG. 5 shows a top view of the traction/pitching control assembly of FIG. 3 attached to the single axle bogie.

As mentioned above, at the area of juncture between the traction link 62*a*, the first linking member 68 and the cross-link 72 is a first attachment member 74*a*. In addition, at the area of juncture between the traction link 62*c*, the second linking member 70 and the cross-link 72 is a second attachment member 74*b*. In the embodiment shown, the first attachment member 74*a*, in conjunction with cross-linking member 72 and the traction link 62*a* forms a bell crank watts mechanism. Likewise, the second attachment member 74*b*, in conjunction with cross-linking member 72 and the traction link 62*c* forms another bell crank watts mechanism. For the remainder of the specification, these attachment members 74*a*, 74*b* will be referred to as bell crank watts mechanisms 74*a* and 74*b*. As best shown in FIG. 5, the bell crank watts mechanism 74*a* is "L" shaped, having a first corner, a second corner and a central pivot point. In the present embodiment, the traction link 62*a* is pivotally attached at a first corner, the first linking member 68 is pivotally attached to a second corner and the cross link 72 is pivotally attached to the pivot point. In this manner, the bell crank watts mechanism 74*a* creates an arm between the first linking member 68 and the traction link 62*a* and another arm between the first linking member 68 and the cross link 72. These two arms that are created by the bell crank watts mechanism 74*a* always remain in the same configuration with respect to each other.

Similarly, the bell crank watts mechanism 74*b* is also "L" shaped, with the traction link 62*c* pivotally attached at a first corner, the second linking member 70 pivotally attached to a second corner and the cross link 72 pivotally attached to the pivot point. As such, the bell crank watts mechanism 74*b* creates an arm between the second linking member 70 and the traction link 62*c* and another arm between the second linking member 70 and the cross link 72. These two arms that are created by the bell crank watts mechanism 74*b* always remain in the same configuration with respect to each other.

Referring back to FIG. 2, at the area of juncture between the traction link 62*b* and the first linking member 68 is an arm member 76*a*. The arm member 76*a* is of the same length as the portion of the bell crank watts mechanism 74*a* that connects the linking member 68 to the traction link 62*a*. As such, the traction link 62*a* and the traction link 62*b* are positioned one on top of the other, such that they are vertically displaced in relation to each other. In addition, at the area of juncture between the fourth traction link 62*d* and the second linking member 70 is an arm member 76*b*. The arm member 76*b* is of the same length as the portion of the bell crank mechanism 74*b* that connects the linking member 70 to the traction link 62*c*. As such, the traction link 62*c* and the fourth link 62*c* are positioned one on top of the other, such that they are vertically displaced in relation to each other. It must also be noted that the lengths of the arms of the L-shaped mechanisms 74*a* and 74*b* may be changed to suit the monorail system on which the combined traction/pitching control mechanism is installed. However, it is important for the lengths of arms 74*a* and 74*b* to be the same as lengths of arms 76*a* and 76*b* respectively.

As best shown in FIG. 2, positioned at each of the upper end portion and lower end portion of the linking members 68 and 70, are pillow blocks 81 for attaching the linking members 68 and 70 to the frame of the monorail car 12 (not shown). The pillow blocks 81 can be attached to the frame of the monorail car 12 in a variety of different manners. For example, the pillow blocks 81 can be attached via a resilient bushing or a sliding bushing at the top and at the bottom of the linking members 68 and 70. These pillow blocks 81 permit the linking members 68 and 70 to pivot freely relative to the monorail car 12 while transmitting longitudinal traction forces between the bogie frame 22 and the monorail car 12. The resulting lateral forces caused by traction forces from cross link 72 are also transferred to the monorail car 12. In one embodiment, the traction links 62*a*, 62*b*, 62*c* and 62*d* are pivotally connected to the bogie frame of the monorail bogie via pivotal ends 63. The pillow blocks 81 are connected to the monorail car 12. In an alternate embodiment that will be described below with respect to FIGS. 13-15, the pillow blocks 81 may be attached to the frame of the monorail bogie, with the ends 63 of each of the traction links 62*a*-62*d* each connected to the monorail car 12.

As will be described in more detail below, the traction/pitching control assembly 40 shown in FIG. 2, is operative for being attached between a monorail bogie 14 and the monorail car body 12, such that it is able to provide the traction restraint and pitching control functionality described above.

Shown in FIGS. 3-6 are different views of the traction/pitching control assembly 40 of FIG. 2 connected to a body portion 22 of the monorail bogie 14. FIGS. 3-6 illustrate the monorail bogie 14 and the traction/pitching control assembly 40 in various different orientations to facilitate a better and clearer understanding. In these figures, the monorail bogie 14 is positioned on the monorail track 16 and for the purposes of clarity, the monorail bogie 14 is shown without the monorail car 12 attached thereto. The monorail track 16 along which the single-axle bogie 14 is designed to travel, includes a substantially horizontal running surface 18 and two side surfaces 20. The monorail track 16 can be positioned along a ground-based guideway, or can be supported on elevated structures above the ground, such as in the case of an elevated transit system.

In the embodiment shown in FIGS. 3-6, the first linking member 68 and the second linking member 70 (namely the torsion rods) are adapted for being attached to the frame of the monorail car 12 (not shown) via the pillow blocks 81, and the traction links 62*a*-62*d* are adapted for being attached to the body portion of the monorail bogie 14.

Positioned at the ends of the traction links 62*a*-62*d* are pivotal ends 63 for connecting the traction/pitching control assembly 40 to the monorail bogie 14. The traction link 62*a*, the traction link 62*b*, the traction link 62*c* and the traction link 62*d* can be attached to the body portion 22 of the bogie 14 via any suitable attachment mechanism that permits the traction links 62*a*, 62*b*, 62*c* and 62*d* to pivot in relation to the body portion 22 of the bogie 14. For example, the traction link 62*a* and the traction link 62*b* may be attached to the monorail bogie 14 via a spherical ball joint (either a resilient or sliding ball joint depending on the desired characteristics in a particular application to establish a desired combination of pitch stiffness, damping and longitudinal traction stiffness and damping). The traction link 62*c* and the traction link 62*d* are attached to the monorail bogie 14 in the same manner.

In an alternative arrangement that will be described in more detail with respect to FIGS. 13-15, the traction/pitching control assembly 40 can be connected between the monorail bogie 14 and the monorail car body 12 in a different manner, such that the pivotal ends 63 of the traction links 62*a*, 62*b*, 62*c* and 62*d* are connected to the monorail car body 12, and the pillow blocks 81 on the first and second linking members 68, 70 are connected to the body portion 22 of the monorail bogie 14.

The following sections describe a non-limiting example of a single axle monorail bogie 14 to which the traction/pitching control assembly 40 of the present invention can be connected. The shapes and proportions of the various components that form the monorail bogie 14 shown in the drawings are purely used for illustration purposes and should be considered as being non-limiting. Deviation in the form of making the components wider, longer or thinner can be made by a person skilled in the art to make the bogie perform in the environment that the system is designed to operate in. In certain places, due to the difference in orientation, certain reference numbers may not be found in certain ones of the figures.

Referring back to FIG. 3, an expanded view of one of the single-axle bogies 14 in accordance with the present invention is shown. The monorail bogie 14 includes a body portion 22 that has a first side portion 24 and a second side portion 26 that are joined together by a front joining portion 28 and a rear joining portion 29. The body portion 22 of the single-axle bogie 14 can be made of steel or a steel alloy, among other possibilities. It should be appreciated that the single-axle bogie 14 can be made of a variety of different materials, so long as the material provides the desired strength and rigidity characteristics for the intended application.

When the single-axle bogie 14 is positioned on the monorail track 16, the front joining portion 28 and the rear joining portion 29 extend over the running surface 18 of the monorail track 16. In addition, the first side portion 24 and the second side portion 26 are positioned such that they are adjacent respective ones of the two side surfaces 20 of the monorail track 16. In the embodiment shown, the front joining portion 28 and the rear joining portion 29 are in the form of rectangular shaped beams. It should, however, be appreciated that the front joining portion 28 and the rear joining portion 29 could be of any shape, size and configuration that is suitable for joining the first side portion 24 and the second side portion 26 of the single-axle bogie 14 together. In addition, the front joining portion 28 and the rear-joining portion 29 are not necessarily required to be facing frontward or rearward when the single-axle bogie 14 is attached to the monorail car 12.

Instead, the front joining portion 28 and the rear joining portion 29 can be positioned in either direction of travel.

Figure 6:
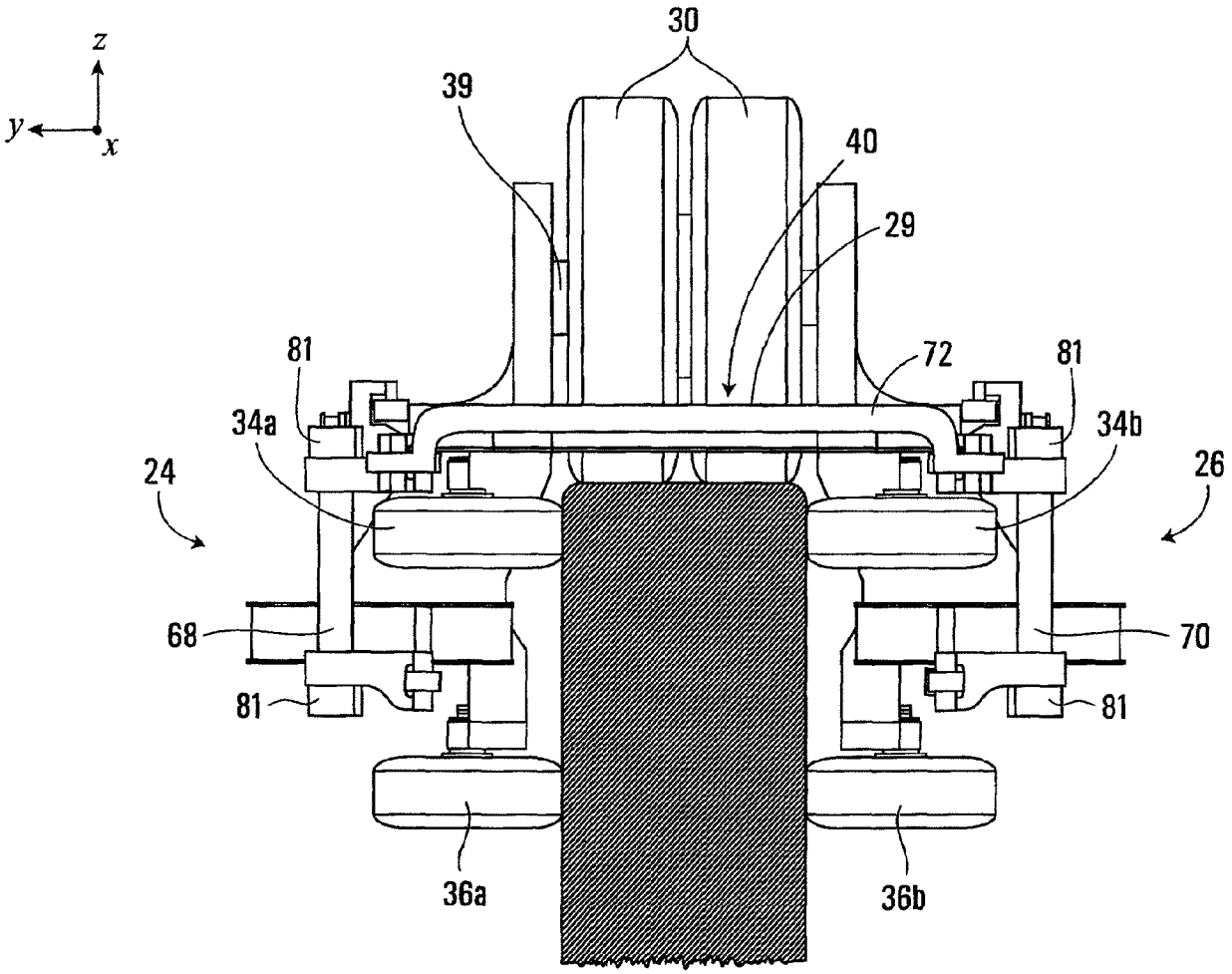
FIG. 6 shows a rear view of the traction/pitching control assembly of FIG. 3 attached to the single axle bogie.

The single axle monorail bogie 14 shown in FIGS. 3-6 is operative for supporting one or more load-bearing wheels 30, an outboard pair of guide wheels 32*a* and 32*b* and an inboard pair of guide wheels 34*a* and 34*b*. As used herein, the term "inboard" refers to the side of the monorail bogie 14 that is closer to the centre of the monorail car body 12 and the term "outboard" refers to the side of the monorail bogie 14 that is closer to the end of the monorail car body 12. In addition, the body portion 22 is operative for supporting two stabilizing wheels 36*a* and 36*b* (as shown in FIG. 6). In the embodiment shown, the stabilizing wheels 36*a* and 36*b* are positioned beneath, and coaxial with, the "inboard" guide wheels 34*a* and 34*b* of the single axle bogie 14. It should, however, be appreciated that the stabilizing wheels 36*a* and 36*b* could also be positioned beneath the "outboard" guide wheels 32*a* and 32*b*, or at any position in between the inboard guide wheels and the outboard guide wheels, without departing from the spirit of the invention. In an alternative embodiment that is not shown, additional stabilizing wheels may be positioned below each of the guide wheels 32*a* and 32*b*, such that the monorail bogie 14 includes four stabilizing wheels.

The load-bearing wheels 30, guide wheels 32*a*, 32*b*, 34*a*, 34*b* and stabilizing wheels 36*a*, 36*b* are generally made of rubber; however, they can also be pneumatic tires, semi-pneumatic tires, solid rubber tires, plastic tires, metal wheels or any other type of tire or wheel known in the art.

Figure 4:
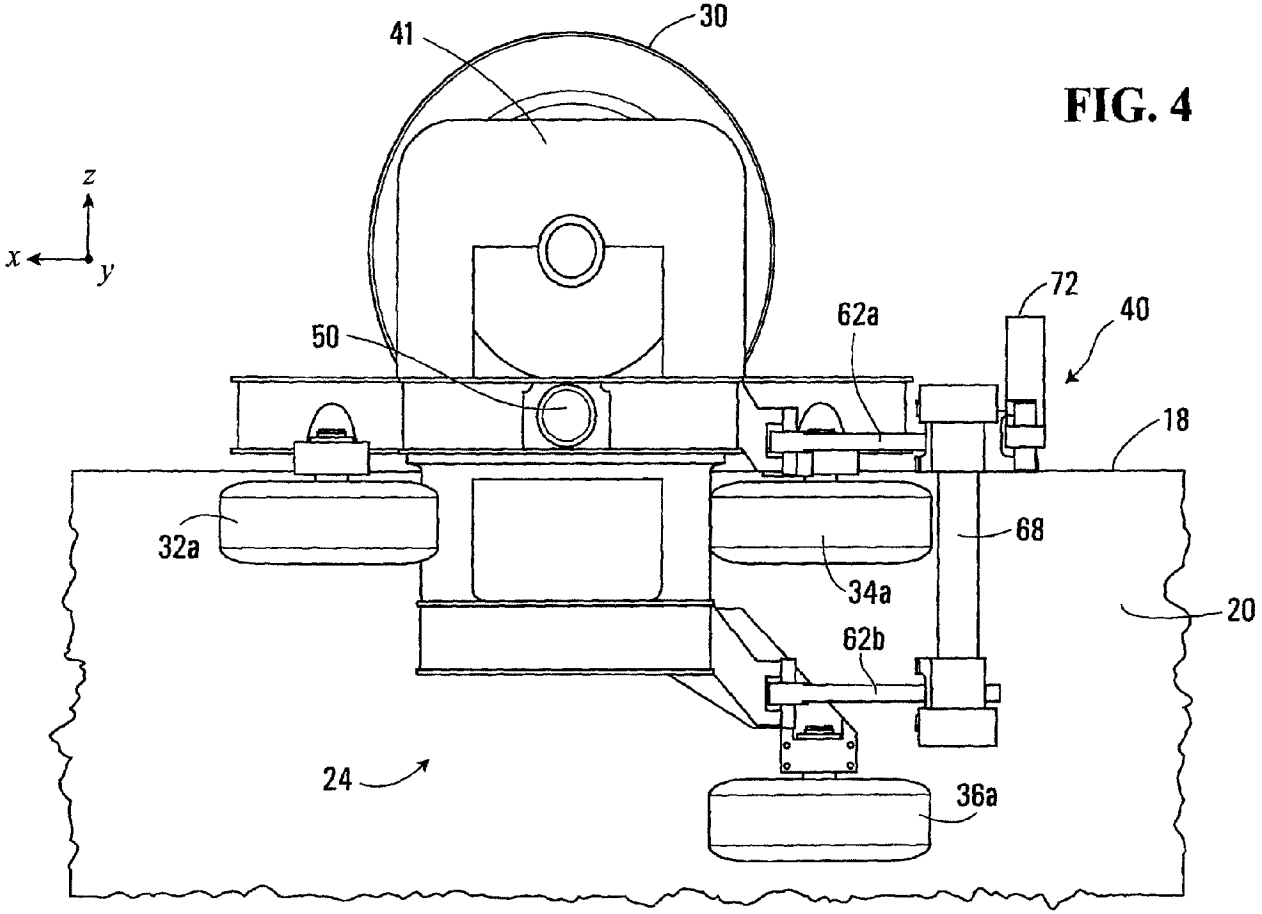
FIG. 4 shows a side view of the traction/pitching control assembly of FIG. 3 attached to the single axle bogie.

As shown in FIGS. 3-6, the traction links 62*a*, 62*b* of the traction/pitching control assembly 40 are connected to the monorail bogie 14 slightly above the guide wheel 34*a* and stabilizing wheel 36*a*, respectively. In addition, the traction link 62*c*, 62*d* are connected to the monorail bogie 14 slightly above the guide wheel 34*b* and the stabilizing wheel 36*b* respectively. FIG. 4 shows a side view of the monorail bogie 14, which shows the points of connection of the traction links 62*a* and 62*b* to the body portion 22 of the monorail bogie 14 quite clearly. A similar connection is also made on the opposite side of the guide beam, where traction links 62*c* and 62*d* are connected to the monorail bogie 14. While FIG. 4 shows an embodied arrangement of the traction links 62*a* and 62*b*, it must be noted that the traction links do not have to be always above the guide wheels and the stabilizing wheels. It must further be noted that as long as the traction links are transposed vertically above each other to accommodate the pitch function, any relative positioning of the traction links with the guide wheel and/or the stabilising wheel is allowed and should be construed as being part of the disclosed invention.

The traction links 62*a*, 62*c* (namely the upper traction links) are attached to the monorail bogie 14 such that their longitudinal axes are positioned substantially parallel to the running surface 18 of the monorail track 16. In addition, the traction links 62*a*, 62*c* are positioned such that they are offset to either side of the running surface 18 of the monorail track 16 and are positioned in substantially the same plane as the running surface 18 of the monorail track 16. By placing the upper traction links 62*a*, 62*c* co-planar with the running surface 18, the torque pitching of the bogie frame is minimized. More specifically, if mounted at the level of the running surface 18, the two traction links 62*a*, 62*c* take the majority of the traction forces and the two lower traction links 62*b*, 62*d* simply provide pitch stabilization in combination with the first and second linking members 68 and 70. In addition, by placing the upper traction links 62*a*, 62*b* on the sides of the running surface 18, they do not extend into the passenger compartment of the monorail vehicle.

The first and second linking members 68, 70 are positioned such that their longitudinal axes are positioned substantially perpendicular to the running surface 18 of the monorail track 16, when in use. As such, the linking members 68, 70 have a substantially vertical orientation in relation to the running surface 18 of the monorail track 16. The linking members 68 and 70 are positioned substantially below the running surface 18 of the monorail track 16, and extend from the bell crank watts mechanisms 74*a*, 74*b* to the arms 76*a*, 76*b*. The two linking members 68 and 70, together with the lower traction links 62*b*, 62*d*, provide pitch stabilization forces.

As mentioned above, the traction links 62*a*, 62*c* are suitable for absorbing the traction forces created by the monorail car assembly 10. The traction forces are also absorbed by the cross link 72, which helps to transfer these forces to the traction links 62*a*, 62*c* via the bell crank watts mechanisms 74*a*, 74*b*. The traction links 62*b*, 62*d* are pitch stabilizing rods for providing pitch stabilization in combination with the first and second linking members 68, 70, so as to prevent the monorail bogie 14 from pitching in relation to the monorail car 12. The combination of the linking members 68, 70 and the lower traction links 62*b*, 62*d* enable the bogie pitch to be adjusted and stabilised. More specifically, the adjustment of the lower pitch traction links 62*b*, 62*d* provides pitch alignment of the bogie frame and guide tires. Similarly, in an alternate embodiment, it is also possible to adjust pitch by adjusting the upper traction links 62*a* and 62*c*. The adjustment of the traction links 62*b*, 62*d* can be made by shimming the ball joint connections (the connection arrangements 63) or by using a male/female pair of threaded rods for the lower placed traction links (namely traction links 62*b* and 62*d*) or by using any other technique known in the art. This adjustment of the pitch stabilization helps to reduce the wear on the guide tires. In another alternate embodiment, the upper traction links 62*a* and 62*c* may be adjusted to set the desired pitch and/or longitudinal position of the monorail bogie.

The bell crank watts mechanisms 74*a*, 74*b* help the traction links 62*a*, 62*c* to absorb the traction loads, and help to take the traction loads outside of the monorail track envelope. More specifically, by taking the traction forces to each side of the monorail track 16, the traction links 62*a*, 62*c* can be positioned at the height of the monorail track running surface 18. This reduces the pitching moments caused by traction forces such that the majority of the traction forces are absorbed by the upper traction links 62*a*, 62*c*. As such, the traction links 62*b*, 62*d* do not need to absorb any traction forces and instead are used to stabilize any remaining pitching moment forces.

In the case where the upper traction links 62*a*, 62*c* are not positioned in substantially the same plane as the running surface 18, then some of the traction forces are transferred to the lower traction links 62*b*, 62*d*. More specifically, when the traction links 62*a*, 62*c* are not aligned with the running surface 18 of the monorail track 16, there is progressive interaction between the traction forces and the pitching alignment.

It should be appreciated that the bell crank watts mechanisms 74*a*, 74*b* can be adjusted such that the distance between the linking members 68 and 70, and the respective traction links 62*a* and 62*c* can change. In such a case the length of the arms 76*a* and 76*b* will also be adjusted such that the length of the arms 76*a* and 76*b* matches the length of the distance between the linking members 68 and 70, and the respective traction links 62*a* and 62*c*. By adjusting these lengths, the movement and force balance in the crosslink 72 of the monorail bogie 14 in relation to the car frame 12 can be optimized for any desired application.

In the embodiment shown, the traction links 62*a*, 62*b* are solid, bone-shaped rods that have a suitable thickness and material strength to be able to handle the traction forces generated. In the embodiment shown, the traction links 62*b*, 62*d* are also solid, bone-shaped rods that have a suitable thickness and material strength to be able to handle the pitching stabilisation required. Each of the traction links 62*a*-62*d* can be of any shape, size, and configuration, so long as they are able to meet their intended function. In addition, it is possible for the upper traction links 62*a*, 62*c* to be different from the lower traction links 62*b*, 62*d*, such that the lower traction links 62*b*, 62*d* can be of lighter duty material than the traction links 62*a* and 62*c*.

The first and second linking members 68 and 70 that are operative for absorbing any torsion forces experienced by the traction/pitching control assembly 40 are hollow tubes. However, it should be understood that the linking members 68 and 70 can have any shape, size and configuration that is suitable for absorbing the torsion forces that will be experienced by a given traction/pitching control assembly 40.

The design, and material characteristics of each of the traction links 62*a*-62*d*, as well as the design and material characteristics of the first and second linking members 68 and 70 can be selected based on the desired characteristics of the traction/pitching control assembly 40. For example, the selection of the stiffness (which could be based on material characteristics, or design) of the traction links 62*a*-62*d* as well as of the first and second linking members 68 and 70, the bell crank watts mechanisms 74*a*, 74*b* and the cross link 72 provide the ability to independently select the bogie traction (longitudinal) stiffness and pitch stiffness.

The materials and design of each individual one of the traction links 62*a*-62*d* as well as the first and second linking members 68 and 70, the cross link 72 and the bell crank watts mechanisms 74*a*, 74*b* can be chosen separately so as to customise the handling of the traction/control assembly 40. More specifically, the stiffness of the traction links 62*a*, 62*b*; the bell crank watts mechanisms 74*a*, 74*b* and the stiffness of the linking members 68 and 70, can be selected independently for customizing the functionality of the traction/pitch control assembly 40. For example, when the traction links 62*a*-62*d* are quite stiff, the pitching control assembly 40 will provide stiff control of the bogie pitch and tire alignment. In addition, if the bell crank mechanisms 74*a* and 74*b* are soft, then the bogie 14 is effectively isolated from vibration, with low longitudinal stiffness relative to the monorail car body. The cross bar 72 can be a stiff crossbar 72 with resilient bell crank mechanisms 74 at each connecting end in order to reduce noise and vibration and to prevent dynamic interactions between the monorail bogie 14 and the frame of the monorail car 12.

By customizing the pitch stiffness and longitudinal stiffness of the bogie 14 relative to the monorail car body 12, the resonance and vibration transmission to the monorail car body 12 as well as undesirable noise, and/or undesirable guide tire wear can be minimized.

As mentioned above, once the traction/pitching control assembly 40 is attached between the monorail bogie 14 and the monorail car body 12, the traction/pitching control assembly 40 is able to prevent the pitching and longitudinal traction movement of the bogie 14 in relation to the monorail car 12. It is also able to prevent longitudinal traction movement, while still permitting yaw movement between the two. For example, as the monorail bogie 12 travels around a curve in the monorail track 16, the linking members 68 and 70 will pivot in relation to the monorail bogie 14, which will push or pull the bell crank mechanisms 74*a*, 74*b* on each of the linking members 68, 70. This, in turn, will cause the linking members 68 and 70 to pivot, thus permitting yaw movement between the monorail bogie 14 and the frame of the monorail car 12. As this happens, the cross link 72 acts to enforce equal and opposite rotation of the linking members 68 and 70 such that the bogie 14 is free to yaw relative to the monorail car 12 but is restrained from longitudinal traction displacement relative to the car 12.

It should be appreciated that although the traction/pitching control assembly 40 shown in FIG. 2 includes both a first pair of traction links; namely the traction links 62*a*, 62*b* and a second pair of traction links; namely the traction links 62*c* and 62*d*, it is possible for the traction/pitching control assembly 40 to include only one pair of traction links. In such an embodiment, the traction/pitching control assembly 40 may include the traction links 62*a*, 62*b* on one side of the traction/pitching control assembly 40 that are interconnected via the first linking member 68, and then only the traction link 62*c* on the other side. As such, the traction link 62*d* and the second linking member 70 are not included, since they are only needed for providing redundancy for the pitching control functionality. In the case where the traction link 62*d* and the second linking member 70 are not included, it is the traction links 62*a*, 62*b* and the first linking member 68 that provide the pitching control, and the traction links 62*a*, 62*c* and the cross link 72 that provide the traction control. While some of the traction forces are still transmitted to the first linking member 68, these forces can be adequately handled. It should thus be noted that the traction/pitching control assembly 40 of the present invention can lose any single one of the traction links 62*a*-62*d* and still retain all traction and pitching control functionality.

In addition, regardless of whether the traction/pitching control assembly 40 includes two pairs of traction links 62*a*-62*d* or only one pair of traction links 62*a*, 62*b*, the traction/pitching control assembly 40 is able to transmit traction forces and provide pitch control in such a way that the traction stiffness can be defined independently from the pitching stiffness.

As shown in FIG. 1, the traction/pitching control assembly 40 is generally positioned on the inboard side of the monorail bogie 14. However, the traction/pitching control assembly 40 could equally be mounted to the "outboard" side of the monorail bogies 14, without detracting from its functionality.

Based on the above description, it should be appreciated that the traction/pitching control assembly 40 enables simultaneous traction restraint via the traction links 62*a*, 62*c*, pitching control via the linking members 68, 70 and the lower traction links 62*b*, 62*d* as well as vibration isolation via the bell crank watts mechanisms 74*a*, 74*b*. In addition, the arrangement of the traction links 62*a*-62*d* and the linking members 68, 70 permits independent control of the traction restraint and pitch control. This is all accomplished while permitting yaw movement between the monorail bogie 14 and the monorail car 12.

As will be described in more detail below, the traction/pitching control assembly 40 can be mounted between the monorail bogie 14 and the monorail car 12 in accordance with many different embodiments. A first, non-limiting, embodiment was shown and described above with respect to FIGS. 3-6, wherein the traction/pitching control assembly 40 is connected between the monorail bogie 14 and the monorail car 12 such that the first pair of traction links 62*a*, 62*b* and the second pair of traction links 62*c*, 62*d* are attached to the body portion 22 of the monorail bogie 14, and such that the first and second linking members 68 and 70 are attached via pillow block 81 to the monorail car 12 (which is not illustrated in the Figures).

Shown in FIGS. 8-12 is a traction/pitching control assembly 40 in accordance with a second non-limiting embodiment of the present invention, wherein like components have been identified with like reference numbers. All the components of the traction/pitching control assembly 40 shown in FIGS. 8-12 are the same as those shown in FIGS. 3-6, however the components are arranged in a slightly different orientation. More specifically, the cross-link 72 is positioned forwardly of the linking members 68 and 70.

Figure 13:
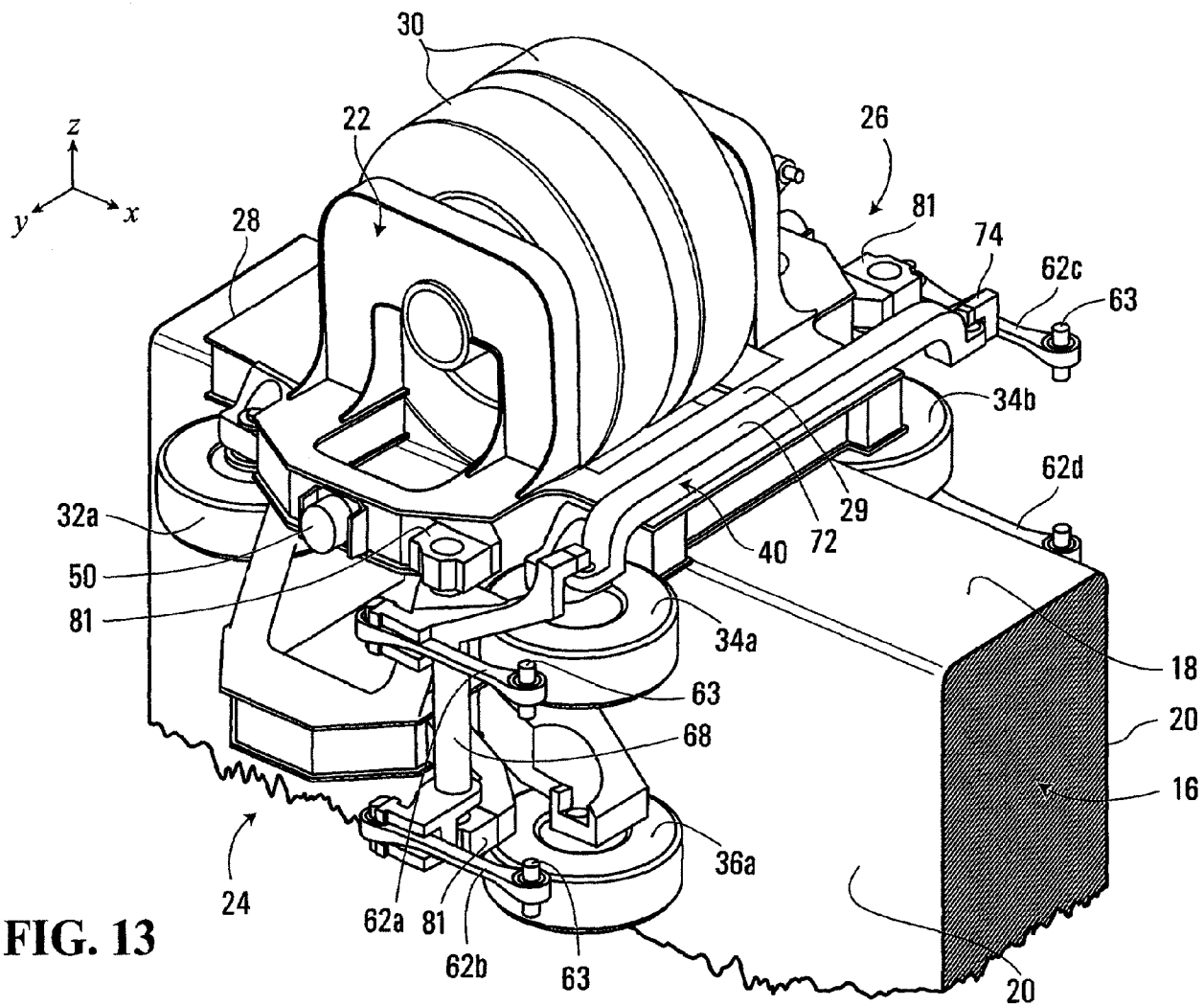
FIG. 13 shows a rear perspective view of a single axle bogie having a traction/pitching control assembly in accordance with a third non-limiting example of implementation of the present invention, attached thereto.
Figure 14:
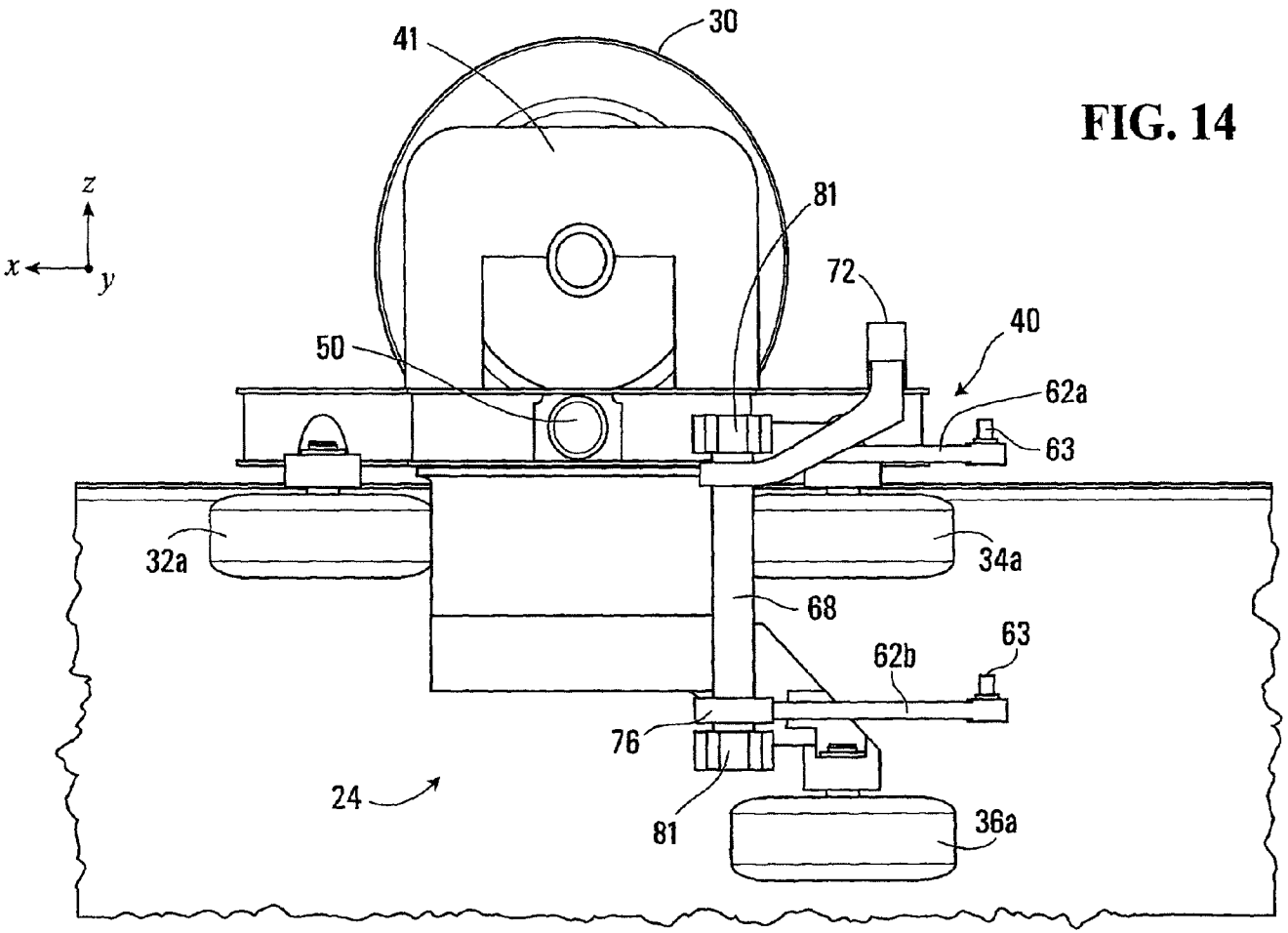
FIG. 14 shows a side view of the traction/pitching control assembly of FIG. 13 attached to the single axle bogie.
Figure 15:
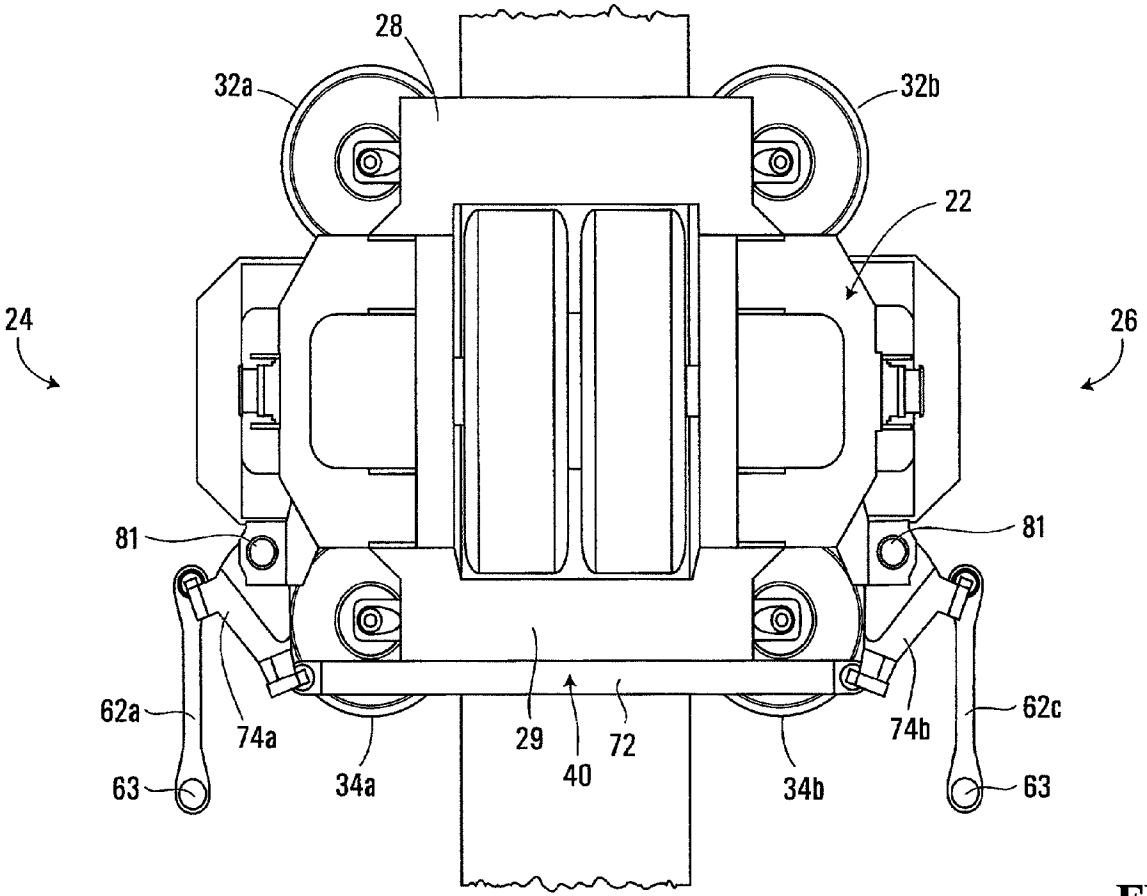
FIG. 15 shows a top view of the traction/pitching control assembly of FIG. 13 attached to the single axle bogie.

Shown in FIGS. 13-15 is a traction/pitching control assembly 40 in accordance with a third non-limiting embodiment of the present invention. In this embodiment, the traction/pitching control assembly 40 is attached between the bogie 14 and the monorail car 12 in a different manner. More specifically, the first and second linking members 68 and 70 are attached to the body portion 22 of the monorail bogie 14, and the first pair of traction links 62*a*, 62*b* and the second pair of traction links 62*c*, 62*d* are attached to the frame of the monorail car 12 (not shown). Therefore, in this second non-limiting embodiment, the traction/pitching control assembly 40 is connected between the body portion 22 of the bogie 14 and the monorail car 12 in the reverse orientation as in the first embodiment. Although FIGS. 13-15 show the traction/pitching control assembly 40 connected to the monorail bogie 14 in accordance with a different embodiment, the parts of the traction/pitching control assembly 40 and the monorail bogie 14 are all the same, and as such, the reference numbers used to refer to the parts will also remain the same.

In this third embodiment, the first and second linking members 68, 70 are attached to the monorail bogie 14 via the pillow blocks 81. As shown in FIG. 14, the pillow block 81 at the upper end of the first linking member 68 is attached to the monorail bogie 14 at a position that is substantially in the same plane as the running surface 18 of the monorail track 16. In addition, the pillow block 81 that is located at the lower end of the first linking member 68 is attached to the body portion 22 of the monorail bogie 14 below (vertically transposed) relative to the upper pillow block 81. In this manner, the first linking member 68 is attached to the first side portion 24 of the monorail bogie 14 such that its longitudinal axis is positioned in a substantially vertical orientation that is perpendicular to the running surface 18 of the monorail track 16. Although not shown in FIG. 13, the second linking member 70 is attached to the second side portion 26 of the bogie 14 via the pillow blocks 81, in the same manner as described with respect to the first linking member 68.

In order to attach the pillow blocks 81 to monorail bogie 14, the pillow blocks 81 can be bolted or welded to the monorail bogie 14. The pillow blocks 81 form the pivots for the linking members 68 and 70 on the bogie frame 22, such that once attached, the first and second linking members 68, 70 are able to pivot in relation to the monorail bogie 14.

In addition, the connection arrangements 63 that are positioned at the end of each of the traction links 62*a*-62*d* are adapted for being connected to the monorail car body 12. Given that the monorail car body 12 is not depicted in FIGS. 13-15, the connection arrangements 63 are not shown attached to anything. It should, however, be appreciated that they are shown in the position and orientation that they will be in when attached to the monorail car body 12. More specifically, the traction links 62*a*, 62*b* are operative for being connected to a portion of the frame of the monorail car 12 that extends beside a first side surface 20 of the monorail track 16 and the traction links 62*c*, 62*d* are operative for being connected to a portion of the frame of the monorail, car 12 that extends beside an opposite side surface 20 of the monorail track 16.

The connection arrangements 63 located on the traction links 62*a*-62*d* may be attached to the car body 12 via a spherical ball joint (either a resilient or sliding ball joint depending on the desired characteristics in a particular application to establish a desired combination of pitch stiffness, damping and longitudinal traction stiffness and damping). Other manners of pivotally connecting the traction links 62*a*-62*d* to the monorail car body 12 can also be used without departing from the spirit of the present invention.

Regardless of how the traction/pitching control assembly 40 is attached between the monorail bogie 14 and the monorail car body 12, it should be appreciated that once the traction/pitching control assembly 40 is attached, the traction/pitching control assembly 40 is able to prevent the pitching and longitudinal traction movement of the bogie 14 in relation to the monorail car 12, while still permitting yaw movement between the two. Additionally, this arrangement also permits lateral and vertical movement, and roll movement between the bogie 14 and the monorail car 12.

As mentioned above, the traction/pitching control assembly 40 is operative for minimizing the pitching and traction movement experienced by the monorail bogie 14. When mounted between the monorail car 12 and the monorail bogie 14 (in either of the configurations described above), the traction links 62*a*, 62*c* are preferably aligned with the running surface 18 of the monorail track 16. By aligning the traction links 62*a*, 62*c* with the running surface 18 of the monorail track 16, the torque pitching between the monorail bogie 14 and the monorail car 12 is minimized under reaction to traction forces. Moreover, the traction links 62*a*, 62*c* (which are the upper placed rods) absorb all of the traction forces, such that the traction links 62*b*, 62*d* provide for the pitch stabilisation. The adjustment of the traction links 62*b*, 62*d* (which are the lower placed rods) enables pitch alignment of the bogie frame 14 and of the guide tires 32*a*, 32*b*, 34*a* and 34*b*. In addition, by including the traction links 62*a*-62*d* at the same height as, or below, the running surface 18 of the monorail track 16, there is added space in the passenger compartment. This is not presently possible in existing assemblies that include the traction links that are positioned above the running surface of the monorail track 16, and transposed above each other on the lateral centreline of the monorail track 16.

Figure 7:
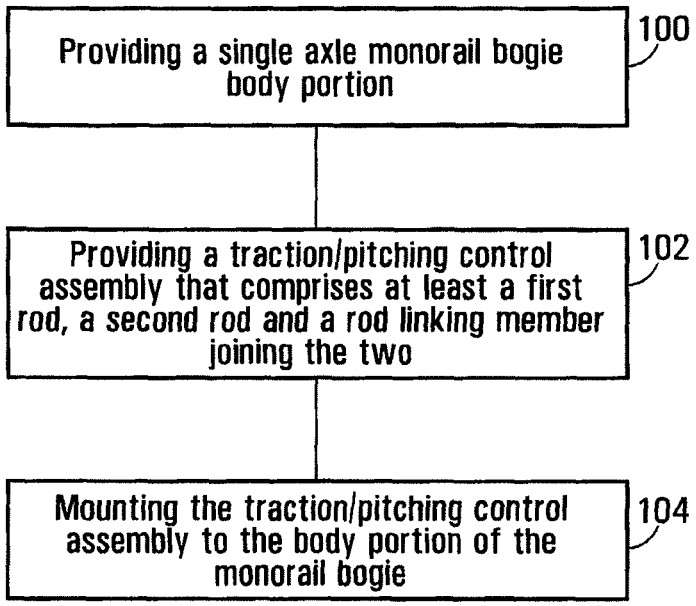
FIG. 7 shows a non-limiting flow diagram of a method of attaching a traction/pitching control assembly to a monorail bogie in accordance with an embodiment of the present invention.
Figure 8:
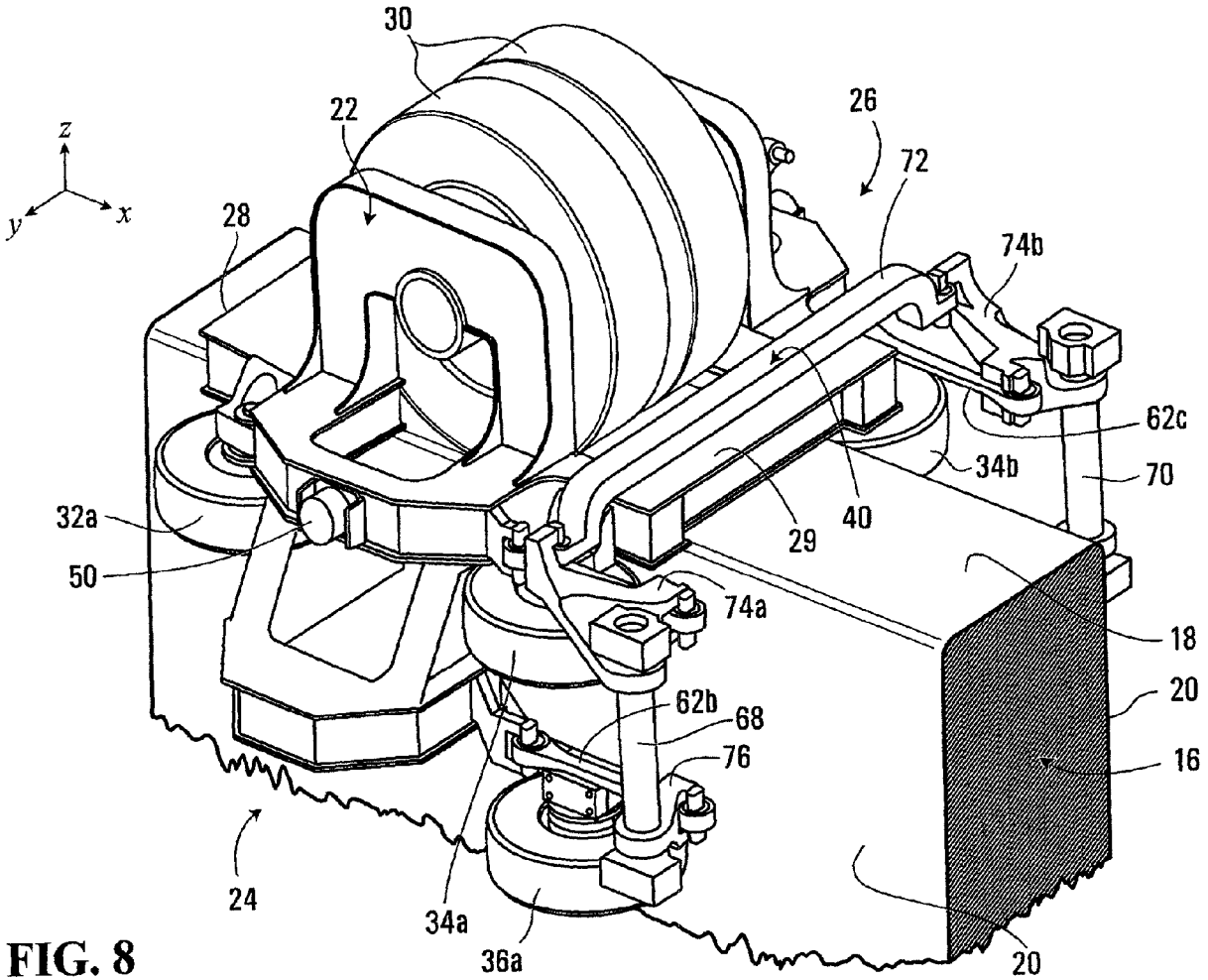
FIG. 8 shows a rear perspective view of a traction/pitching control assembly in accordance with a second non-limiting example of implementation of the present invention, attached to a single axle bogie.
Figure 9:
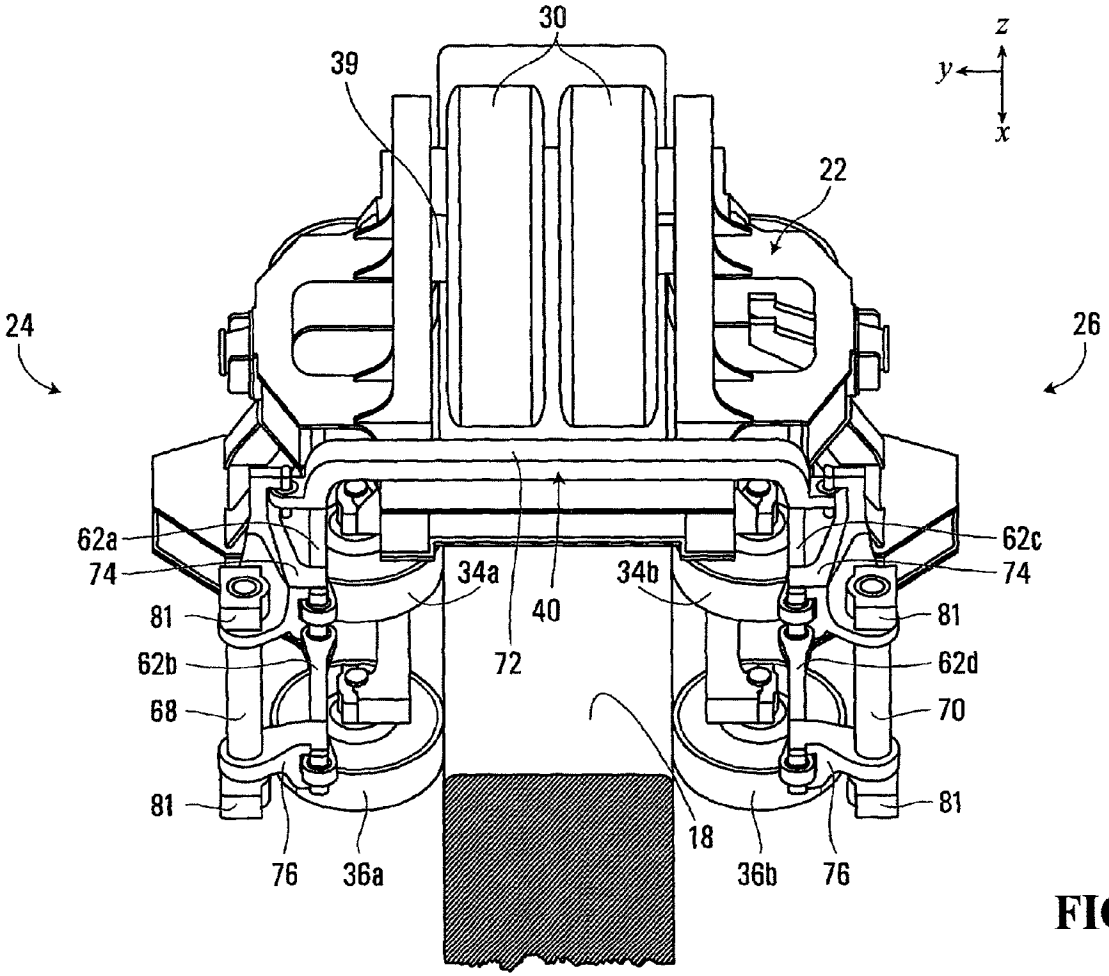
FIG. 9 shows a top perspective view of the traction/pitching control assembly of FIG. 8 attached to the single axle bogie.
Figure 10:
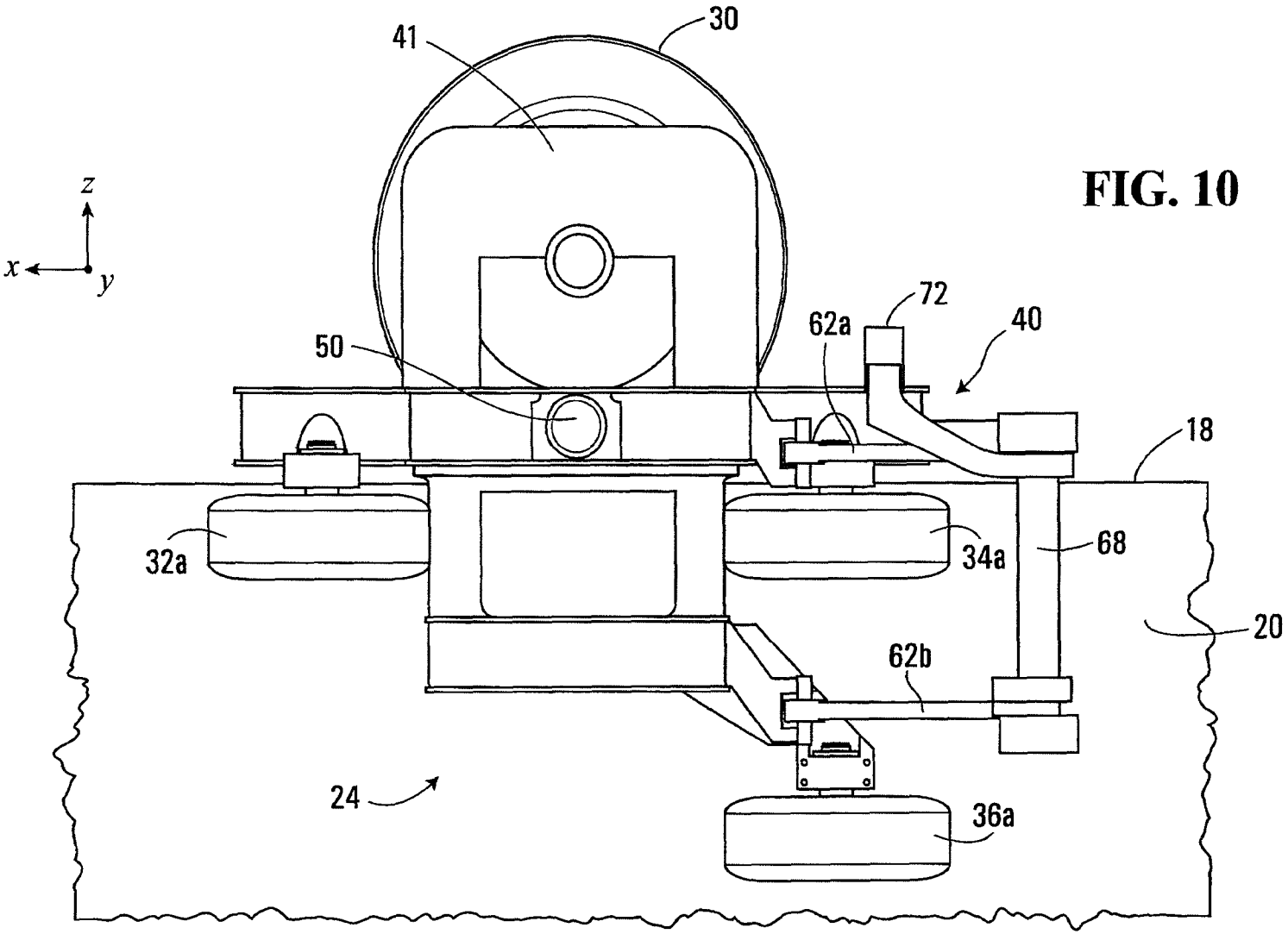
FIG. 10 shows a side view of the traction/pitching control assembly of FIG. 9 attached to the single axle bogie.
Figure 11:
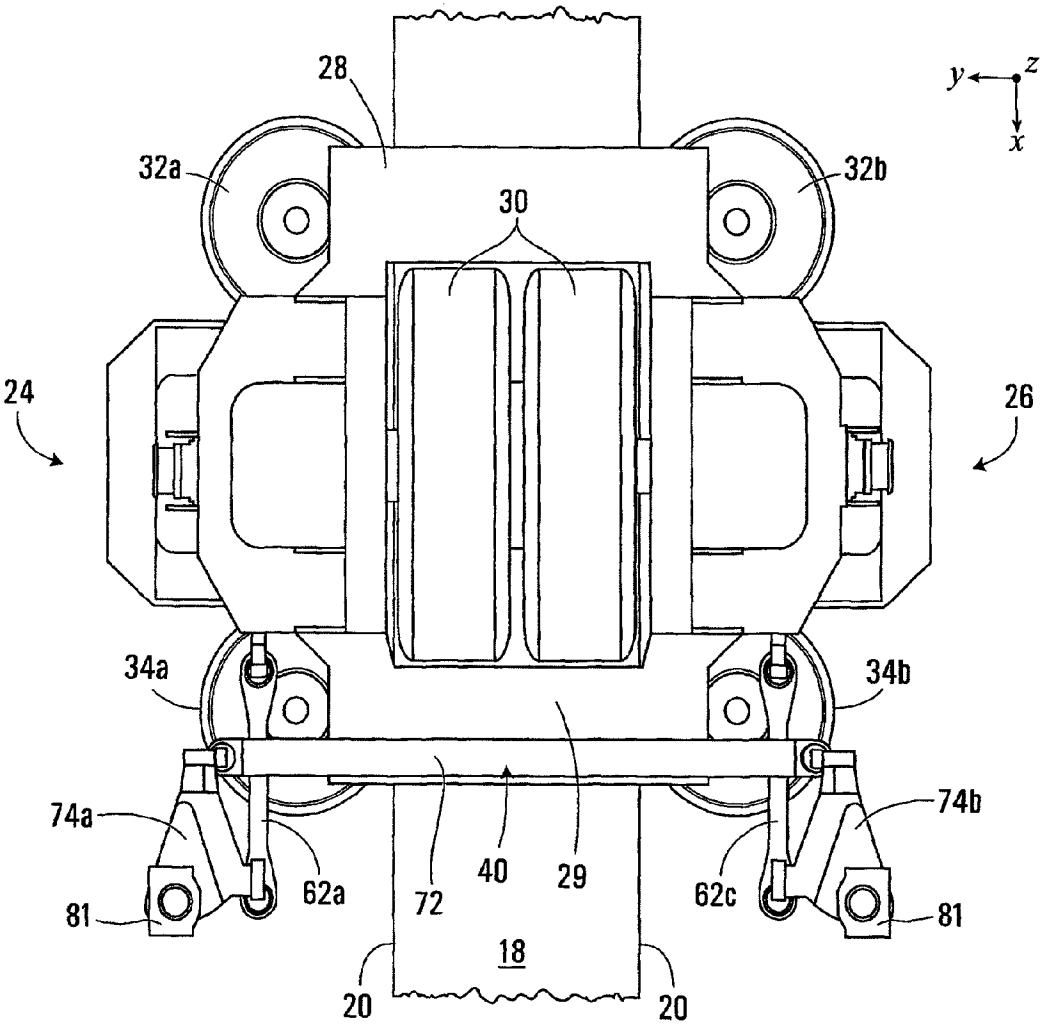
FIG. 11 shows a top view of the traction/pitching control assembly of FIG. 9 attached to the single axle bogie.
Figure 12:
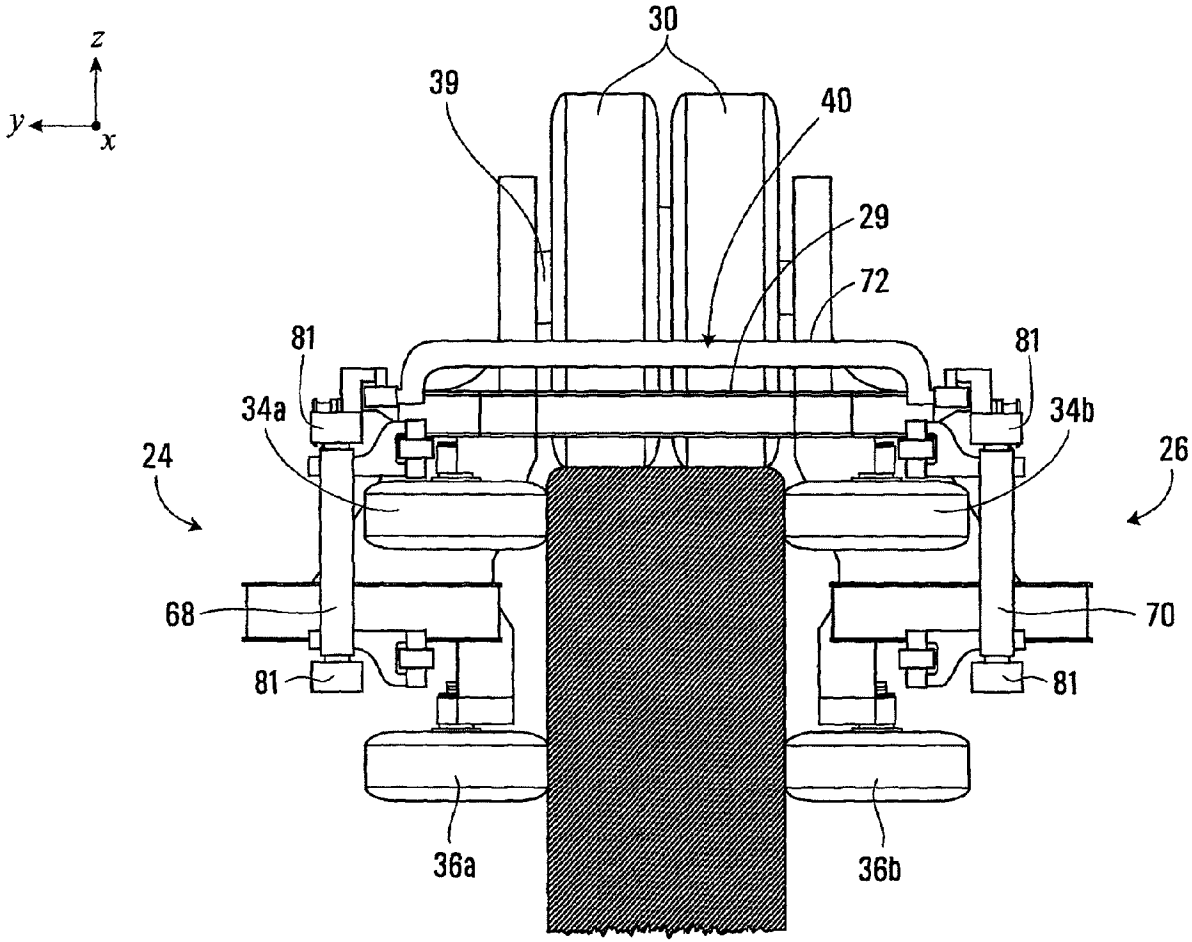
FIG. 12 shows a rear view of the traction/pitching control assembly of FIG. 9 attached to the single axle bogie.

An exemplary method of assembling a monorail bogie 14 that has a traction/pitching control assembly 40 in accordance with the present invention will be described below with reference to the flow chart of FIG. 7. Firstly, at step 100, the method comprises providing a body portion of a single-axle monorail bogie 14 that is suitable for supporting a monorail car 12 over a monorail track 16. The monorail track 16 has a running surface 18 and two side surfaces 20. At step 102, the method comprises providing a traction/pitching control assembly 40 that comprises a traction link 62*a*, a traction link 62*b* and a linking member 68. The linking member 68 has a first end portion and a second end portion. The traction link 62*a* is attached to the first end portion of the linking member 68, and the traction link 62*b* is attached to the second end portion of the linking member 68. Finally, at step 104, the method comprises mounting the traction/pitching control assembly 40 to the body portion of the monorail bogie 14. This can be done by mounting the traction link 62*a* and the traction link 62*b* to one of the body portion of the bogie 14 and the monorail car 12, and by mounting the linking member 68 to the other one of the body portion of the bogie 14 and the monorail car 12.

The traction/pitching control assembly 40 further comprises a traction link 62*c* and a cross link 72 that has a first end and a second end. At the first end, the cross link 72 is pivotally connected to the traction link 62*a* and the linking member 68 via a first attachment member 74*a*, and at the second end, the cross link 72 is pivotally connected via a second attachment member 74*b* to the traction link 62*c*. As such, although not shown in FIG. 7, the method further comprises mounting the traction link 62*c* to one of the body portion of the bogie 14 and the monorail car 12.

Furthermore, an exemplary method of retrofitting an existing single-axle monorail bogie 14 with a traction/pitching control assembly 40 will be described below. The single axle monorail bogie will comprise a body portion that is suitable for supporting a monorail car over a monorail track. The monorail track has a running surface, a first side surface and a second side surface. The method comprises providing a traction/pitching control assembly 40 that comprises a traction link 62*a*, a traction link 62*b* and a linking member 68 having a first end portion and a second end portion. The traction link 62*a* is attached to the first end portion of the linking member 68 and the traction link 62*b* is attached to the second end portion of the linking member 68. The method further comprises pivotally attaching the traction link 62*a* and the traction link 62*b* to one of the body portion of the single axle bogie 14 and the monorail car 12, and pivotally attaching the linking member to the other one of the body portion of the single bogie 14 and the monorail car 12.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A traction/pitching control assembly for connection to a single axle monorail bogie frame supporting a monorail car, comprising:

a first traction link and a second traction link for mounting on a first side portion of the monorail bogie frame, each traction link having a first end and a second end;

a third traction link and a fourth traction link for mounting on a second side portion of the monorail bogie frame, the second side portion being opposite from the first side portion;

a crosslink connected between the first traction link and the third traction link; and a first linking member having a first end and a second end wherein, the first ends of the first and second traction links are connected respectively to the first and second ends of the first linking member; and the second ends of the first and second traction links are connected to one of the monorail bogie frame and the monorail car, at least one of said first, second, third and fourth traction links having a direction of longitudinal extent, the at least one of said first, second, third and fourth traction links being oriented such that the direction of longitudinal extent extends along a running direction of the monorail bogie frame.

2. The traction/pitching control assembly of claim 1, wherein said first traction link and said second traction link are vertically spaced apart with respect to one another.

3. The traction/pitching control assembly of claim 1, wherein said third traction link and said fourth traction link are vertically spaced apart with respect to one another.

4. The traction/pitching control assembly of claim 1, wherein the single axle monorail bogie frame runs on a running surface, the running surface being spaced above ground level and wherein at least one of said first, second, third and fourth traction links are located between the running surface and the ground level.

5. The traction/pitching control assembly of claim 1, wherein the third traction link and the fourth traction link each have a first end and a second end; and wherein the assembly further comprises:

a second linking member having a first end and a second end;

wherein, the first ends of the third and the fourth traction links are connected to the respective first and second ends of the second linking member, and the second ends of the third and the fourth traction links are connected to one of the monorail bogie frame and the monorail car.

6. The traction/pitching control assembly of claim 5, wherein the crosslink is connected between the first and the second linking members.

7. The traction/pitching control assembly of claim 5, wherein the first traction link and the third traction link are pivotally connected to the first linking member and the second linking member respectively via bell crank watts mechanisms.

8. A single axle monorail bogie assembly for supporting a monorail car, comprising:

a monorail bogie body portion including at least one load bearing wheel, and at least one guide wheel and one stabilizing wheel on either side of the monorail bogie body portion, the monorail bogie body portion comprising a first side portion and a second side portion; and a traction/pitching control assembly connected to the monorail bogie body portion, the traction/pitching control assembly comprising:

a first traction link and a second traction link for being positioned on a first side portion of the monorail bogie body portion, each traction link having a first end and a second end;

a third traction link and a fourth traction link for being positioned on a second side portion of the monorail bogie body portion, the second side portion being opposite from the first side portion;

a crosslink connected between the first traction link and the third traction link; and a first linking member having a first end and a second end wherein, the first ends of the first and second traction links are connected respectively to the first and second ends of the first linking member;

and the second ends of the first and second traction links are connected to one of the monorail bogie body portion and the monorail car, at least one of said first, second, third and fourth traction links having a direction of longitudinal extent, the at least one of said first, second, third and fourth traction links being oriented such that the direction of longitudinal extent extends along a running direction of the monorail bogie frame.

9. The single axle monorail bogie assembly of claim 8, wherein said first traction link and said second traction link are vertically spaced apart with respect to one another.

10. The single axle monorail bogie assembly of claim 8, wherein the first traction link is pivotally connected to the first linking member via a bell crank watts mechanism with a pivot point about the first linking member.

11. The single axle monorail bogie assembly of claim 8, wherein the monorail car runs on a running surface, the running surface being spaced above ground level and wherein at least one of said first, second, third and fourth traction links are located between the running surface and the ground level.

12. The single axle monorail bogie assembly of claim 8, wherein the first and the third traction links are arranged to be co-planar with a running surface for the monorail bogie assembly.

13. The single axle monorail bogie assembly of claim 12, wherein at least one of the first and second linking members comprises a longitudinal axis that is substantially perpendicular to the running surface.

14. The single axle monorail bogie assembly of claim 8, wherein:

the third traction link and the fourth traction link each have a first end and a second end; and wherein the assembly further comprises:

a second linking member having a first end and a second end;

wherein, the first ends of the third and the fourth traction links are connected respectively to the first and second ends of the second linking member, and the second ends of the third and the fourth traction links are connected to one of the monorail bogie body portion and the monorail car.

15. The single axle monorail bogie assembly of claim 14, wherein said third traction link and said fourth traction link are vertically spaced apart with respect to one another.

16. The single axle monorail bogie assembly of claim 14, wherein the crosslink connects the first and the second linking members.

17. The single axle monorail bogie assembly of claim 16, wherein a length of an arm connecting the second traction link to the crosslink member is substantially equal to a length of an arm of the bell crank mechanism connecting the first traction link to the crosslink.

18. The single axle monorail bogie assembly of claim 14, wherein the third traction link is pivotally connected to the second linking member via a bell crank watts mechanism with a pivot point about the second linking member.

19. The single axle monorail bogie assembly of claim 14, wherein the second ends of the traction links are pivotally connected to the monorail bogie body portion.

20. The single axle monorail bogie assembly of claim 19, wherein at least one of the first and the second linking members is connected to the monorail car.

21. The single axle monorail bogie assembly of claim 14, wherein the second end of each of the first, second, third and fourth traction links is connected to the monorail car and the first and second linking members are connected to the monorail bogie body portion.

22. A traction/pitching control assembly for connection to a single axle monorail bogie frame supporting a monorail car, comprising:

a first traction link and a second traction link for mounting on a first side portion of the monorail bogie frame;

a third traction link for mounting on a second side portion of the monorail bogie frame, the second side portion being opposite from the first side portion;

a first linking member having a first end and a second end, the first end being connected to the first traction link via a first bell crank mechanism, and pivotally connected at the second end to the second traction link; and a crosslink being connected at a first end portion to the first bell crank mechanism and at a second end portion to the third traction link via a second bell crank mechanism.

23. The traction/pitching control assembly of claim 22, wherein at least one of said first, second and third traction links extends along the bogie running direction.

24. The traction/pitching control assembly of claim 22, wherein said first traction link and said second traction link are vertically spaced apart with respect to one another.

25. The traction/pitching control assembly of claim 22, wherein at least one of said first, second and third traction links is connected to one of the monorail bogie frame and the monorail car.

26. The traction/pitching control assembly of claim 22, wherein the single axle monorail bogie frame runs on a running surface, the running surface being spaced above ground level and wherein at least one of said first, second and third traction links are located between the running surface and the ground level.

27. The traction/pitching control assembly of claim 22, wherein the single axle monorail bogie frame includes at least one load bearing wheel, and at least one guide wheel and one stabilizing wheel on either side of the single axle monorail bogie frame.

28. The traction/pitching control assembly of claim 22, wherein the first and the third traction links are arranged to be co-planar with a running surface for the monorail bogie assembly.

29. The traction/pitching control assembly of claim 22, further comprising fourth traction link for mounting on the second side portion of the monorail bogie frame.

30. The traction/pitching control assembly of claim 29, wherein said third traction link and said fourth traction link are vertically spaced apart with respect to one another.

31. The traction/pitching control assembly of claim 29, further comprising a second linking member having a first end and a second end, the first end of the second linking member being connected to the third traction link via the second bell crank mechanism, and pivotally connected at the second end of the second linking member to the fourth traction link.

32. The traction/pitching control assembly of claim 31, wherein at least one of the first and second linking members comprises a longitudinal axis that is substantially perpendicular to the running surface.

33. The traction/pitching control assembly of claim 31, wherein at least one of the first and the second linking members is connected to the monorail car.

34. The traction/pitching control assembly of claim 31, wherein each of the first, second, third and fourth traction links is connected to the monorail car and the first and second linking members are connected to the monorail bogie frame.

* * * * *